US012808214B2

(12) United States Patent
Ward

(10) Patent No.: US 12,808,214 B2
(45) Date of Patent: Nov. 24, 2026

(54) SWIMMING POOL INSERT

(71) Applicant: Craig Geoffrey Ward, Queensville (CA)

(72) Inventor: Craig Geoffrey Ward, Queensville (CA)

(73) Assignee: Craig Geoffrey Ward

( * ) Notice: Subject to any disclaimer, the term of this patent is extended or adjusted under 35 U.S.C. 154(b) by 3 days.

(21) Appl. No.: 18/765,191

(22) Filed: Jul. 5, 2024

(65) Prior Publication Data

US 2026/0009248 A1 Jan. 8, 2026

(51) Int. Cl.
*E04H 4/06* (2006.01)
*E04H 4/14* (2006.01)

(52) U.S. Cl.
CPC ..... *E04H 4/065* (2013.01); *E04H 4/145* (2013.01)

(58) Field of Classification Search
CPC ..... E04H 4/14; E04H 4/145; E04H 4/065
See application file for complete search history.

(56) References Cited

U.S. PATENT DOCUMENTS

| | | | | |
|---|---|---|---|---|
| 3,813,703 | A | 6/1974 | Beaudin, Jr. | |
| 4,271,542 | A | 6/1981 | Wood et al. | |
| 5,920,921 | A | 7/1999 | Poole | |
| 5,953,767 | A * | 9/1999 | Cloffey | E04H 4/065 108/66 |
| 6,598,562 | B1 * | 7/2003 | Dutkiewicz | E06C 1/39 119/706 |
| 11,274,460 | B2 * | 3/2022 | Masterson | E04H 4/144 |
| 11,680,420 | B1 | 6/2023 | Barnes et al. | |
| 2001/0032355 | A1 | 10/2001 | DeWitt | |
| 2008/0119097 | A1 | 5/2008 | Segnan | |
| 2008/0227069 | A1 | 9/2008 | Lamberty | |
| 2009/0119829 | A1 | 5/2009 | Swanson et al. | |
| 2009/0241251 | A1 | 10/2009 | Blinco | |
| 2022/0025669 | A1 | 1/2022 | Mcdermott et al. | |

FOREIGN PATENT DOCUMENTS

IT AN20130168 A1 3/2015

* cited by examiner

*Primary Examiner* — Janie M Loeppke
(74) *Attorney, Agent, or Firm* — Jordan Sworen; Daniel Enea; Argus Intellectual Enterprises, LLC

(57) ABSTRACT

A swimming pool insert is provided. The swimming pool insert includes a lower frame formed by a plurality of tubular members removably secured to one another via lower frame joints. An upper frame, positioned above the lower frame and is positioned above a water line of the swimming pool when in use, is formed by a plurality of tubular members joined by a first joint housing, a second joint housing, and a corner joint housing. A liner extends between the upper and lower frames which is designed to receive and retain water from the pool. The upper frame is designed to secure to a corner of the swimming pool. The pool insert creates a safe, shallow play area for children while maintaining the pool's functionality and is easily installable and removable.

19 Claims, 5 Drawing Sheets

SWIMMING POOL INSERT

BACKGROUND OF THE INVENTION

The present invention relates to pool inserts designed to decrease the depth of swimming pools to create a safe play area for smaller children. More specifically, the swimming pool insert comprises a frame designed to secure to a corner of a swimming pool that can be easily installed and removed without compromising the functionality or cleaning mechanisms of the pool.

Swimming pools are popular recreational facilities for families, offering a fun and relaxing environment. However, they also pose significant safety risks, particularly for young children who are not strong swimmers. Drowning is a leading cause of accidental death for children, and even shallow pools can be hazardous. Traditional safety measures, such as pool fences and alarms, focus on preventing access to the pool but do not address the danger once a child is in the water.

Various products and methods have been developed to mitigate these risks. For example, some pools feature built-in shallow areas, but these designs are often fixed and cannot be adjusted to meet the changing needs of a family. Other solutions include inflatable kiddie pools placed inside larger pools, but these are prone to punctures, require constant supervision, and do not integrate well with the pool's filtration system. Additionally, some rigid structures attempt to partition off a section of the pool, but they can be cumbersome to install and remove, and may interfere with pool cleaning mechanisms.

Despite these attempts, existing solutions have significant shortcomings. Inflatable options lack durability and stability, making them unreliable for long-term use. Fixed shallow areas are inflexible and cannot be adjusted as children grow or family needs change. Partitioning devices can be complex and time-consuming to install, detracting from their practicality. Furthermore, many of these options do not seamlessly integrate with the existing pool structure, often hindering maintenance and cleaning processes.

Therefore, there exists a need for a pool insert that provides a safe, adjustable play area within a standard pool, without the drawbacks associated with current alternatives. The present invention fulfills this need by offering a pool insert with a rigid frame that creates a firm and stable shallow area. The upper frame includes a raised guard to enhance safety, preventing children from crossing into deeper sections of the pool. This design does not interfere with the pool's function or cleaning mechanisms, ensuring that it remains a convenient and practical solution for families.

In light of the systems and methods disclosed in the known art, it is submitted that the present invention substantially diverges in design elements and methods from the known art and consequently it is clear that there is a need in the art for an improvement swimming pool inserts for decreasing a depth of a swimming pool. In this regard the instant invention substantially fulfills these needs.

SUMMARY OF THE INVENTION

In view of the foregoing disadvantages inherent in the known systems for swimming pool inserts now present in the known art, the present invention provides a swimming pool insert having an upper and lower frame designed to secure to a corner of a swimming pool that can be easily installed and removed without compromising the functionality or cleaning mechanisms of the pool.

It is an objective of the present invention to provide an embodiment of the swimming pool insert comprising a lower frame formed by a plurality of tubular members removably secured to one another via lower frame joints. An upper frame, positioned above the lower frame and is positioned above a water line of the swimming pool when in use, is formed by a plurality of tubular members joined by a first joint housing, a second joint housing, and a corner joint housing. A liner extends between the upper and lower frames, designed to receive and retain water from the pool.

It is another objective of the present invention to provide a swimming pool insert that secures to a corner of the swimming pool. The frames are designed to fit within and secure to the pool's corner, remaining unsupported by the pool's lower surface, thus providing a stable and efficient configuration.

It is another objective of the present invention to provide a swimming pool insert wherein the liner is void of openings to prevent water from passing through. This design maintains the integrity of the shallow play area and prevents any contaminated water from entering into the swimming pool.

It is another objective of the present invention to provide a swimming pool insert wherein the tubular members float to ensure that the insert remains buoyant and stable within the pool.

It is another objective of the present invention to provide a swimming pool insert wherein the components are removably securable to one another to allow the insert to be easily installable and removable.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purpose of presenting a brief and clear description of the present invention, the preferred embodiment will be discussed as used for forming a shallow swimming area within a corner of a swimming pool. The figures are intended for representative purposes only and should not be considered to be limiting in any respect.

Reference will now be made in detail to the exemplary embodiment(s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment.

Figure 1:
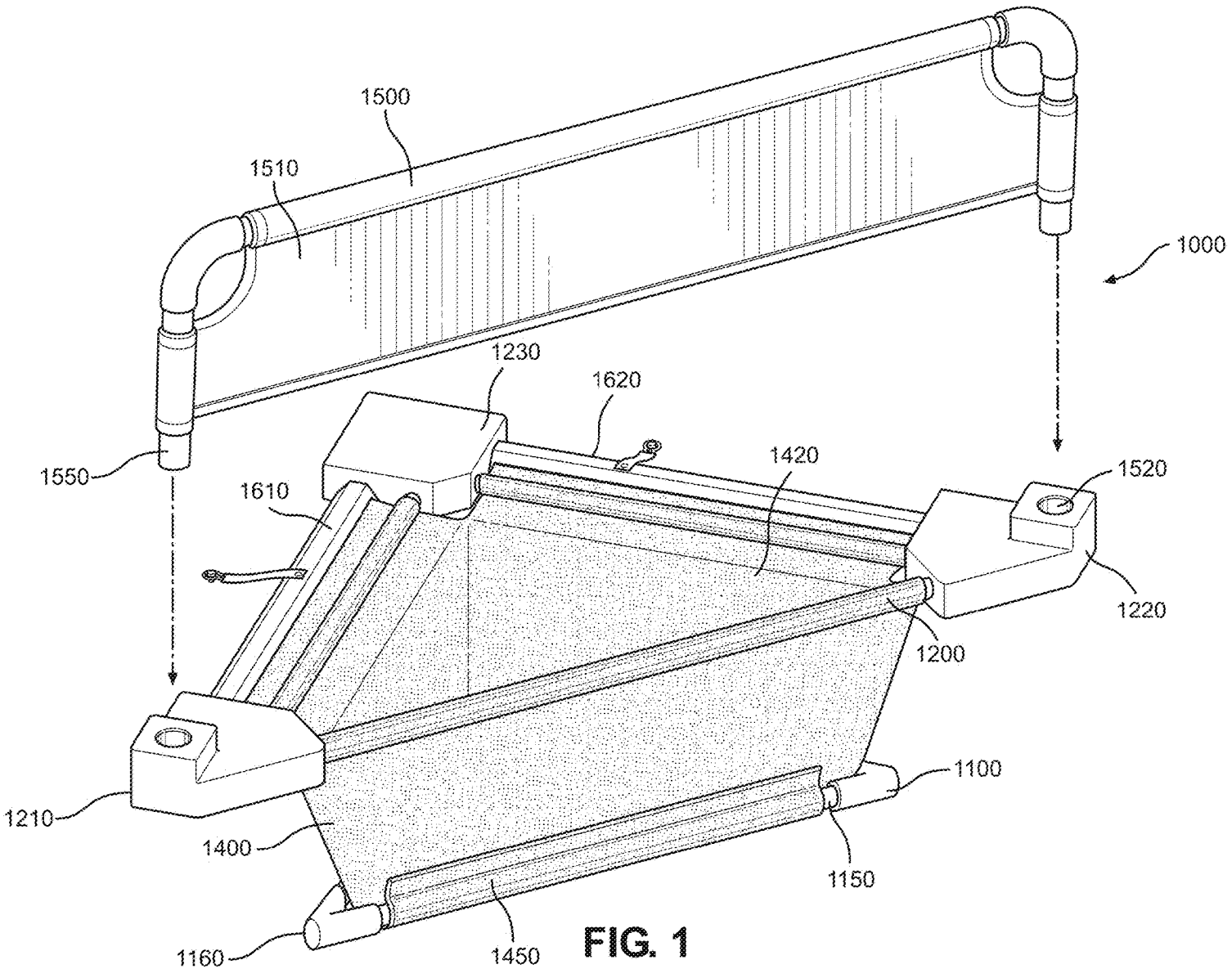
FIG. 1 shows a perspective view of an embodiment of the swimming pool insert.
Figure 2:
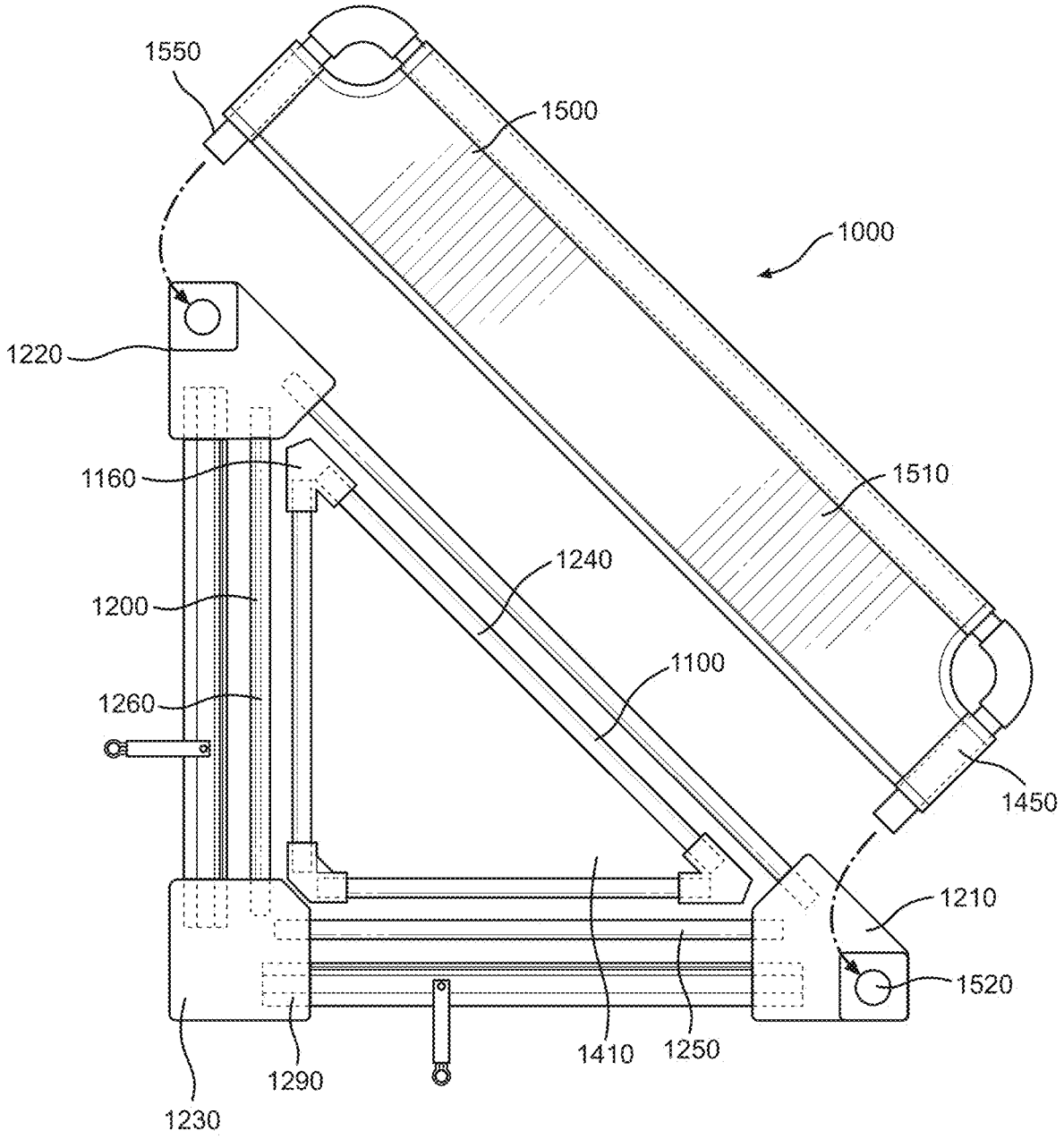
FIG. 2 shows a top elevation view of an embodiment of the swimming pool insert.
Figure 3:
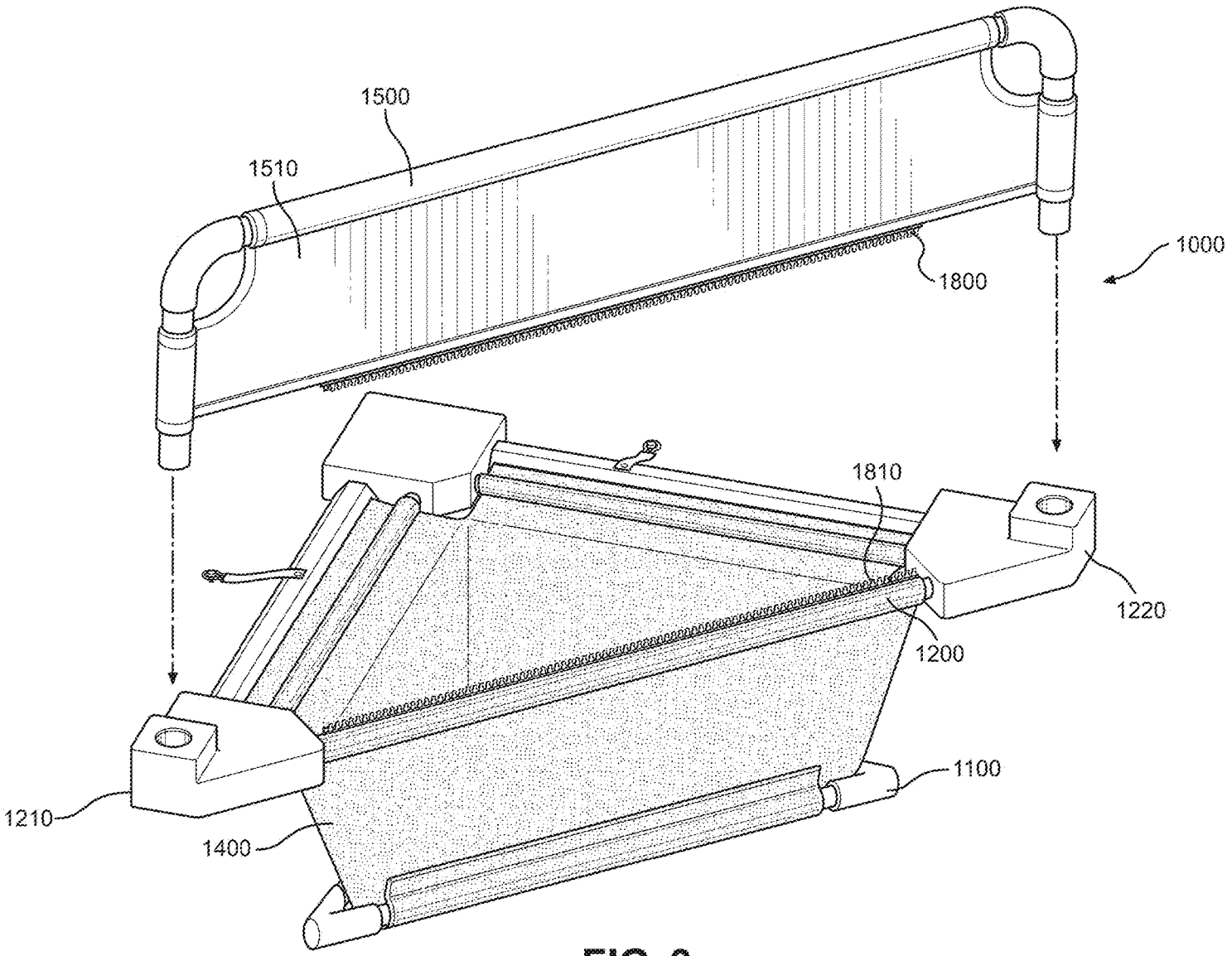
FIG. 3 shows a perspective view of an alternate embodiment of the swimming pool insert.

Referring now to FIGS. 1 and 2, there is shown a perspective view and a top elevation view of an embodiment of the swimming pool insert, respectively. The swimming pool insert 1000 comprises a lower frame 1100 and an upper frame 1200 connected to one another via a liner 1300. The lower and upper frame are formed from tubular members 1150. In the illustrated embodiment, each tubular member is hollow and configured to float (as seen in FIG. 3). The lower frame 1100 is adapted to be disposed in the swimming pool, but above the pools lower surface or floor, such that the lower frame 1100 is suspended in the water from the upper frame 1200. The lower frame 1100 and upper frame 1200 are designed to fit within and secure to a corner of the swimming pool, wherein the swimming pool insert 1000 remains unsupported by the lower surface of the swimming pool.

The tubular members 1150 forming the lower frame 1100 are removably secured to one another via a lower frame joint 1160. Each lower frame joint connects a pair of tubular members to one another. In the illustrated embodiment, the lower frame 1100 is formed by three tubular members 1150 connected by three joints 1160 with sockets sized to receive the tubular members to form a triangular shape. In some embodiments, the tubular members are curved and can be curved to fit a curved pool edge.

The upper frame 1200 is positioned above the lower frame in an assembled configuration and is adapted to be disposed above a water line of the swimming pool. The upper frame 1200 is formed by a plurality of upper frame tubular members joined together by a first joint housing 1210, a second joint housing 1220, and a corner joint housing 1230. In the illustrated embodiment, the first joint housing 1210 and the second joint housing 1220 are configured to removably receive a first upper frame tubular member 1240. The corner joint housing 1230 and the first joint housing 1210 are configured to removably receive a second upper frame tubular member 1250, wherein the corner joint housing 1230 and the second joint housing 1220 are configured to removably receive a third upper frame tubular member 1260. In an assembled and installed configuration, the first upper tubular member 1240 is water facing, wherein the second and third upper frame tubular members 1250, 1260 are aligned with the corner of the pool. In the illustrated embodiment, each of the corner joint housing 1230, the first joint housing 1210, and the second joint housing 1220 comprise sockets 1270 on adjacent lateral sides thereof for removably receiving the upper frame tubular members therein. The joint housings and the tubular members all lie on same plane in the assembled configuration.

In the illustrated embodiment, the lower frame and the upper frame 1100, 1200 are rigid and each form triangular shaped cross sections along a horizontal plane. In the shown embodiment, the lower and upper frames 1100, 1200 are concentric with one another, wherein the lower frame 1100 comprises a smaller exterior perimeter than an exterior perimeter of the upper frame. The frames 1100, 1200 are composed of any suitable rigid material, such as aluminum, polyvinyl chloride, high-density polyethylene, fiberglass reinforced plastic, among other suitable materials.

A liner 1400 extends between the upper and lower frame 1100, 1200 that is configured to receive and retain water from the swimming pool therein. In the illustrated embodiment, the liner 1400 is void of openings to prevent water from passing therethrough. In an assembled configuration, the liner 1400 forms a triangular cross section and comprises a closed bottom end 1410 and an open upper end 1420. The open upper end 1420 is adapted to receive a user therein. The closed bottom end 1410 is adapted to support the user and prevent the user from passing the boundary of the lower frame 1100. In this way, if the water within the liner becomes contaminated during use, it will be prevented from entering the remainder of the swimming pool. The liner 1400 is composed of any suitable material that prevents liquid from passing therethrough, such as synthetic rubber, thermoplastic polymer, and the like. In some embodiments, the liner is composed of a material that allows water to pass therethrough.

In some embodiments, the liner is rigid and remains in a triangular prism shape without the frames attached thereto. In alternate embodiments, the liner is flexible and comprises crossmembers extending perpendicularly between the upper and lower frames to create tension in the liner. The crossmembers extend through sleeves disposed on the liner.

In the illustrated embodiment, the swimming pool insert 1000 further comprises a plurality of sleeves 1450 disposed on the liner 1400 configured to receive a tubular member 1150 therethrough. Each sleeve comprises a pair of openings on the lateral sides thereof for allowing a tubular member 1150 to pass through. In the illustrated embodiment, the sleeves are formed of the same material as the liner 1400. However, in alternate embodiment, the sleeves are formed from any suitable material, including material different from the liner.

In the shown embodiments, the swimming pool insert 1000 further comprises an upper raised guard 1500 that is removably securable to the first and second joint housings 1210, 1220 of the upper frame 1200. The upper raised guard 1500 comprises a U-shaped frame having a pair of distal ends 1550. A guard liner 1510 extends within the frame and aligns with the liner 1400 along the pool facing side thereof. The guard line 1510 prevents the user frame passing over the upper frame 1200. The first and second joint housings 1210, 1220 each comprise an aperture 1520 on an upper side thereof configured to receive the distal ends of the upper raised guard 1500. The upper raised guard 1500 is configured to prevent a user from crossing into a deeper section of the swimming pool.

Referring now to FIG. 3, there is shown an alternate embodiment of the swimming pool insert. In some embodiments the guard liner 1510 of the upper raised guard is securable to the liner 1400 attached to the lower and upper frame 1100, 1200 via a fastener. In the shown embodiment, the fastener is a zipper connection that comprises mating sides 1800, 1810. The first mating side 1800 extends along a length of a lower most end of the guard liner 1510 and the second mating side 1810 extends along an upper edge of the liner 1400 portion extending between the first and second housing joint 1210, 1220. In other embodiments, any suitable fastener is used to secured the liner 1400 to the guard liner 1510 to prevent any gaps therebetween.

Figure 4:
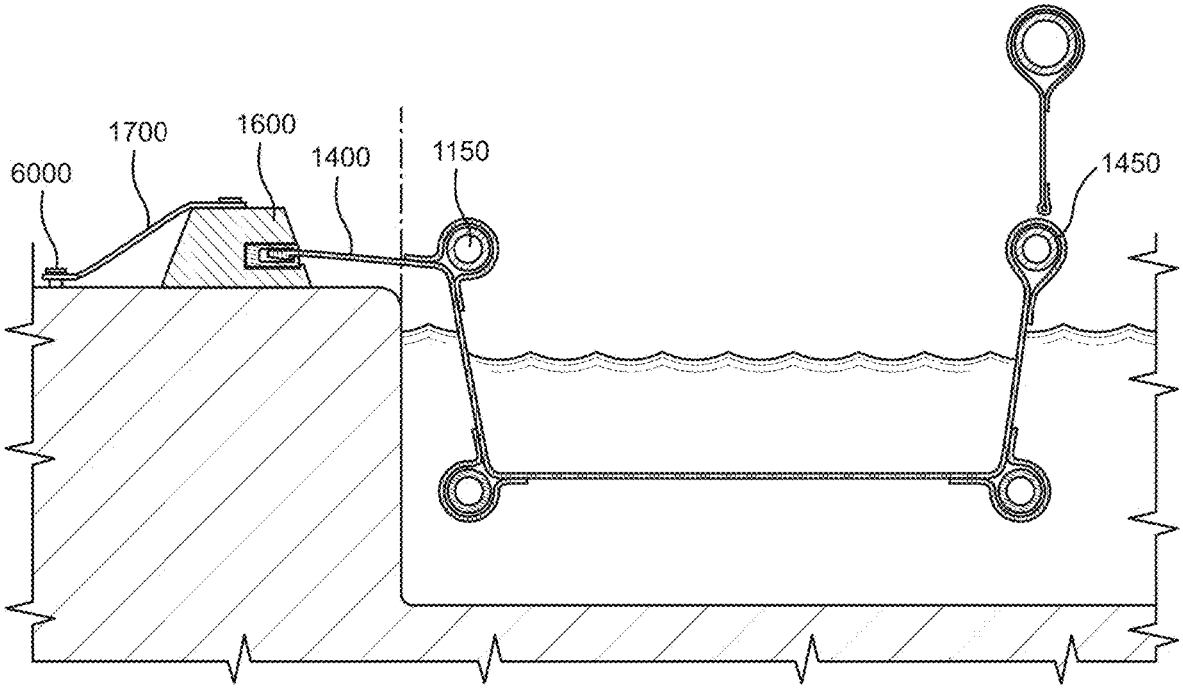
FIG. 4 shows a cross-sectional view of an embodiment of the swimming pool insert in use.
Figure 5:
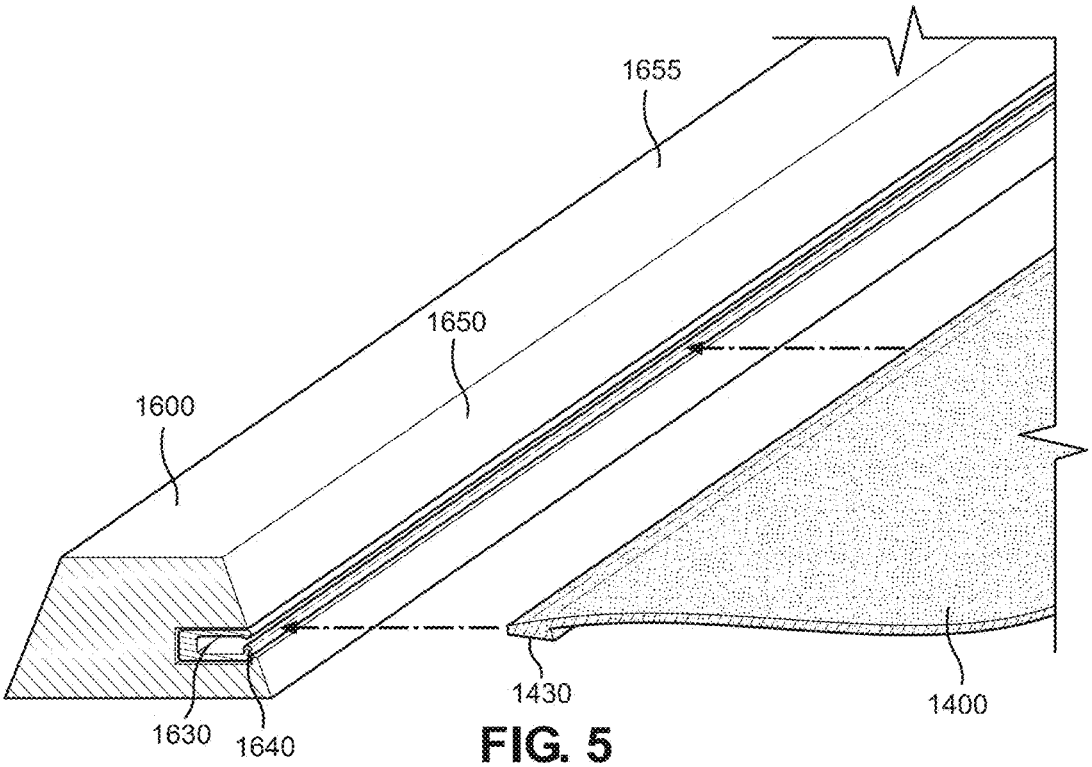
FIG. 5 shows an exploded view of a support bar and the liner of an embodiment of the swimming pool insert.

Referring now to FIGS. 4 and 5, there is shown a cross-sectional view of an embodiment of the swimming pool insert in use and an exploded view of a support bar and the liner of the swimming pool insert, respectively. The swimming pool insert 1000 further comprises a pair of support bars 1600 intend to receive the liner 1400 therein and provide support to the upper and lower frames 1100, 1200. A first support bar 1610 extends between the corner joint housing 1230 and the first joint housing 1210, wherein a second support bar 1620 extends between the corner joint housing 1230 and the second joint housing 1220 (as seen in FIG. 1). The first and second support bar each comprise an opening 1630 with a track 1640 along an interior side 1650 to removably receive the liner 1400 therein. In the shown embodiment, the track 1640 and opening 1630 extend along an entire length of the support bar 1600. The liner 1400 comprises a dovetail with a tapered edge 1430 that slides along the track of the support bars 1600. In the shown embodiment, the support bar 1600 comprises a trapezoidal cross-sectional shape having a wider base that rests flat on a pool deck surface.

In some embodiments, a strap 1700 extends from an upper side 1655 of each of each support bar 1600. The strap 1700 is configured to secure to a fastener 6000 exterior to the swimming pool, such as a clip used to receive a conventional pool cover fastener thereon.

Figure 6:
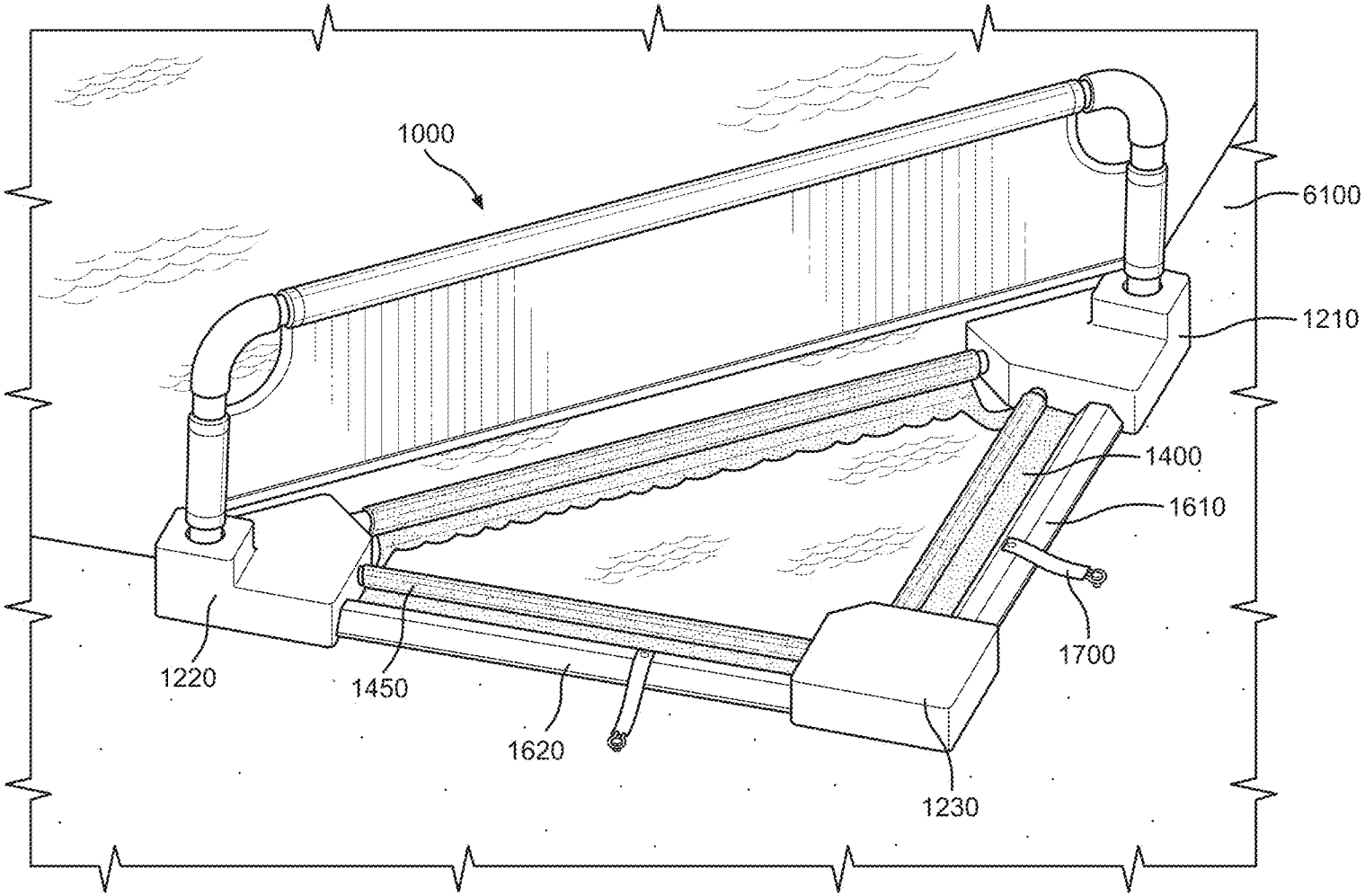
FIG. 6 shows a perspective view of an embodiment of the swimming pool insert.

Referring now to FIG. 6, there is shown a perspective view of an embodiment of the swimming pool insert in use. In operation, the swimming pool insert 1000 is assembled by passing the tubular members through sleeves 1450 on the liner 1400 to form the upper and lower frames. The lower frame joints connect the tubular members of the lower frame together, wherein the tubular members of the upper frame are inserted into the first joint housing 1210, the second joint housing 1220, and the corner joint housing 1230. The upper edge of the liner 1400 is inserted into the first and second support bars 1610, 1620 and placed a corner ledge 6100 of the swimming pool. The interior of liner 1400 is filled with water once the insert 1000 is assembled. The upper raised guard 1500 is inserted into the first and second joint housings. The straps 1700 are connected to the pool deck fasteners, wherein the swimming pool insert 1000 remains floating above the bottom surface of the pool. The swimming pool insert can be easily disassembled and stored in a compact configuration after use.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A swimming pool insert for decreasing the depth of a swimming pool, comprising:

a lower frame configured to be disposed in the swimming pool, the lower frame formed by a plurality of lower frame tubular members removably secured to one another via a lower frame joint;

an upper frame configured to be disposed above a water line of the swimming pool, the upper frame formed by a plurality of upper frame tubular members joined by a first joint housing, a second joint housing, and a corner joint housing;

a liner extending between the upper and lower frames forming a compartment configured to receive and retain water from the swimming pool therein;

wherein the first joint housing, the second joint housing, and the corner joint housing are adapted to rest on a ledge of the swimming pool;

wherein an in-use-configuration, the swimming pool insert is raised from a lower surface of the swimming pool to form a gap between the swimming pool insert and the lower surface of the swimming pool.

2. The swimming pool insert of claim 1, wherein the lower frame and the upper frame are rigid.

3. The swimming pool insert of claim 1, wherein the lower frame and the upper frame each form triangular shaped cross sections.

4. The swimming pool insert of claim 3, wherein the first joint housing and the second joint housing are configured to removably receive a first upper frame tubular member of the plurality of upper frame tubular members, the corner joint housing and the first joint housing configured to removably receive a second upper frame tubular member of the plurality of upper frame tubular members, and the corner joint housing and the second joint housing configured to removably receive a third upper frame tubular member of the plurality of upper frame tubular members.

5. The swimming pool insert of claim 1, wherein the upper frame is adapted to secure to a corner of the swimming pool.

6. The swimming pool insert of claim 1, wherein the upper frame further comprises:

a first support bar and a second support bar, the first support bar extends between the corner joint housing and the first joint housing and the second support bar extends between the corner joint housing and the second joint housing;

wherein the first and second support bars are configured to rest on a deck of the swimming pool and retain the liner.

7. The swimming pool insert of claim 6, wherein the first and second support bar each comprise an opening with a track along a first side thereof to removably receive the liner therein.

8. The swimming pool insert of claim 7, wherein the track extends along an entire length of the first and second support bar.

9. The swimming pool insert of claim 7, wherein the liner comprises a tapered edge configured to slide along the tracks of the first and second support bars.

10. The swimming pool insert of claim 7, further comprising a strap extending from an upper side of each of the first and second support bars, wherein the strap is configured to secure to a fastener exterior to the swimming pool.

11. The swimming pool insert of claim 1, further comprising an upper raised guard removably securable to the first and second joint housings of the upper frame, wherein the upper raised guard is configured to prevent a user from crossing into a deeper section of the swimming pool.

12. The swimming pool insert of claim 11, wherein the first and second joint housings each comprise an aperture on an upper side thereof configured to receive distal ends of the upper raised guard.

13. The swimming pool insert of claim 11, wherein the upper raised guard is vertically aligned with the liner.

14. The swimming pool insert of claim 1, wherein the liner is void of openings to prevent water from passing through the liner.

15. The swimming pool insert of claim 1, wherein each of the plurality of upper frame tubular members are configured to float.

16. The swimming pool insert of claim 1, wherein the liner comprises a plurality of sleeves configured to receive the plurality of upper and lower frame members therethrough.

17. The swimming pool insert of claim 1, wherein each of the corner joint housing, the first joint housing, and the second joint housing comprise sockets on adjacent lateral sides thereof for removably receiving the plurality of upper frame tubular members therein.

18. The swimming pool insert of claim 1, wherein the lower frame comprises a smaller exterior perimeter than an exterior perimeter of the upper frame.

19. The swimming pool insert of claim 1, wherein the upper frame and the lower frame are concentric.

* * * * *